US009328556B2

(12) United States Patent
Blair et al.

(10) Patent No.: US 9,328,556 B2
(45) Date of Patent: May 3, 2016

(54) MOTORIZED TRANSITIONAL SHADE SYSTEM

(71) Applicant: Lutron Electronics Co., Inc., Coopersburg, PA (US)

(72) Inventors: Edward J. Blair, Telford, PA (US); Samuel F. Chambers, Gwynedd Valley, PA (US); Stephen Lundy, Coopersburg, PA (US); Robert J. Thompson, Bethlehem, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 0 days.

(21) Appl. No.: 14/491,278

(22) Filed: Sep. 19, 2014

(65) Prior Publication Data

US 2015/0083350 A1 Mar. 26, 2015

Related U.S. Application Data

(60) Provisional application No. 61/880,343, filed on Sep. 20, 2013.

(51) Int. Cl.

| | |
|---|---|
| ***E06B 9/24*** | (2006.01) |
| ***E06B 9/44*** | (2006.01) |
| ***E06B 9/64*** | (2006.01) |

(52) U.S. Cl.
CPC ... *E06B 9/44* (2013.01); *E06B 9/64* (2013.01); *E06B 2009/2405* (2013.01)

(58) Field of Classification Search
CPC ..... E06B 9/44; E06B 9/64; E06B 2009/2405
See application file for complete search history.

(56) References Cited

U.S. PATENT DOCUMENTS

| | | | | |
|---|---|---|---|---|
| 5,538,065 | A * | 7/1996 | G eraud | A47H 23/06 160/120 |
| 5,698,958 | A * | 12/1997 | Domel | E06B 9/307 160/168.1 P |
| 6,189,592 | B1 * | 2/2001 | Domel | E06B 9/24 160/241 |
| 7,207,371 | B2 * | 4/2007 | Hsu | E06B 9/40 160/120 |
| 7,267,156 | B2 * | 9/2007 | Byeon | E06B 9/40 160/121.1 |
| 7,281,565 | B2 | 10/2007 | Carmen, Jr. et al. | |
| 7,537,040 | B2 | 5/2009 | Carmen, Jr. et al. | |

(Continued)

OTHER PUBLICATIONS

Lafayette Interior Fashions, Allure Transitional Shades, *Installation Instructions Standard, Two-On-One & Sundown Shades*, Apr. 2011, 4 pages.

*Primary Examiner* — Katherine Mitchell
*Assistant Examiner* — Abe Massad
(74) *Attorney, Agent, or Firm* — Condo Roccia Koptiw LLP

(57) ABSTRACT

A motorized transitional shade system may move a covering material between open, closed, view, and privacy positions. The covering material may define respective pluralities of opaque and transparent sections that are arranged in an alternating pattern. A bottom bar that is movably supported by the covering material may define first and second portions of the covering material. The opaque and transparent sections in the first and second portions of the covering material may permit visibility through the covering material in a view position, and may impede visibility through the covering material in a privacy position. If movement of the covering material is halted at an intermediate position that is between the open and closed positions, the motorized transitional shade system may cause the motor to rotate the roller tube to move the covering material to a next lowest privacy position or to a next highest view position.

30 Claims, 6 Drawing Sheets

(56) References Cited

U.S. PATENT DOCUMENTS

| | | | | |
|---|---|---|---|---|
| 7,635,018 | B2 | 12/2009 | Carmen, Jr. et al. | |
| 7,737,653 | B2 | 6/2010 | Carmen, Jr. et al. | |
| 7,806,160 | B2 * | 10/2010 | Byeon | E06B 9/40 160/11 |
| 7,839,109 | B2 | 11/2010 | Carmen, Jr. et al. | |
| 2010/0258255 | A1 * | 10/2010 | Lee | E06B 9/42 160/319 |
| 2012/0043029 | A1 | 2/2012 | Gaskill et al. | |
| 2012/0048481 | A1 | 3/2012 | Feldstein et al. | |
| 2012/0048490 | A1 | 3/2012 | Feldstein et al. | |
| 2012/0050596 | A1 | 3/2012 | Feldstein et al. | |
| 2012/0053729 | A1 | 3/2012 | Feldstein et al. | |
| 2012/0053731 | A1 | 3/2012 | Feldstein et al. | |
| 2012/0073765 | A1 * | 3/2012 | Hontz | E06B 9/304 160/84.02 |
| 2013/0240159 | A1 * | 9/2013 | Safarik | E06B 9/26 160/168.1 V |

* cited by examiner

MOTORIZED TRANSITIONAL SHADE SYSTEM

CROSS-REFERENCE TO RELATED APPLICATIONS

This application claims priority to U.S. provisional patent application No. 61/880,343, filed Sep. 20, 2013, which is incorporated herein by reference in its entirety.

BACKGROUND

A typical transitional shade system may include a housing that is attached to a structure adjacent an opening, a roller tube that is rotatably mounted within the housing, and a covering material. The covering material may have a first end that is windingly attached to the roller tube and a second end that is fixed to the housing. The covering material may define respective pluralities of horizontal opaque sections and transparent sections that are arranged in an alternating pattern. The transitional shade system may include a bottom bar that is configured to maintain the covering material in tension.

The covering material may be moved between an open position wherein the covering material does not cover the opening, a closed position wherein the covering material covers the opening, one or more view positions in which the covering material at least partially covers the opening and visualization through the covering material is permitted, and one or more privacy positions in which the covering material at least partially covers the opening and visualization through the covering material is impeded.

The covering material of such a transitional shade system is typically moved between the various positions via a pull cord that is attached to the roller tube. However, moving the covering material of a transitional shade system with a pull cord may be undesirable. For example, in installations that include multiple transitional shade systems, it may be time consuming and burdensome to manually adjust each covering material. Additionally, a pull cord may distract from the aesthetic of a transitional shade system installation.

SUMMARY

As described herein, a motorized transitional shade system may include a housing, a roller tube that is rotatably supported by the housing, a covering material that is windingly attached to the roller tube, and a motor drive unit. The motor drive unit may include a motor that is operably coupled to the roller tube and a control system. Rotation of the roller tube by the motor causes the covering material to move between an open position wherein the covering material is wound about the roller tube, a closed position wherein the covering material covers an opening, one or more view positions in which visualization through the covering material is permitted, and one or more privacy positions in which visualization through the covering material is impeded.

The covering material may include a first end that is windingly attached to the roller tube and a second end that is attached to the housing. The covering material may define respective pluralities of opaque and transparent sections that are arranged in an alternating pattern between the first and second ends of the covering material. Each opaque section may be an opaque stripe that extends across the width of the covering material, and each transparent section may be a transparent stripe that extends across the width of the covering material.

The motorized transitional shade system may further include a bottom bar that is configured to be movably supported by the covering material, such that a first portion of the covering material extends from the roller tube to the bottom bar, and a second portion of the covering material extends from the bottom bar to the second end of the covering material. The bottom bar may be a roller that rides along the covering material as the covering material is moved between the various positions.

When the covering material is in a privacy position, a transparent section in the first portion of the covering material may align with an opaque section in the second portion of the covering material. When the covering material is in a view position, a transparent section in the first portion of the covering material may align with a transparent section in the second portion of the covering material.

The control system may be configured to, upon receipt of a first command from a remote control device, cause the motor to rotate the roller tube to move the covering material, for example toward a preset position of the covering material. The control system may be configured to, upon receipt of a second command from the remote control device, cause the motor to halt rotation of the roller tube with the covering material at an intermediate position that is between the open and closed positions. The intermediate position may, for example, be between a particular privacy position and a particular view position that is adjacent to the particular privacy position. The control system may be configured to automatically cause the motor to, rotate the roller tube to move the covering material from the intermediate position to a privacy position or to a view position, for example based on a determination of whether visualization through the covering material is desired. The control system may be configured to determine that visualization through the covering material is not desired if the covering material is moving toward the closed position when movement of the covering material is halted, and may be configured to determined that visualization through the covering material is desired if the covering material is moving toward the open position when movement of the covering material is halted.

DETAILED DESCRIPTION

FIGS. 1A-1B and 2A-2C depict an example motorized transitional shade system 10. The example motorized transitional shade system 10 may be referred to herein as a motorized shade system. As shown, the motorized transitional shade system 10 includes a housing 14 (e.g., a pocket or a headrail) that is configured to be coupled to or otherwise mounted to a structure. For example, the housing 14 may be configured to be mounted to (e.g., attached to) a window frame, wall, or other structure, such that the motorized transitional shade system 10 is mounted proximate to an opening (e.g., over or in the opening), such as a window for example. The motorized transitional shade system may further include a roller tube 18 that is rotatably mounted (e.g., rotatably supported) within the housing 14. The motorized transitional shade system 10 may further include a motor drive unit 16 (e.g., an electronic drive unit) that is configured to rotate the roller tube 18.

Figure 1B:
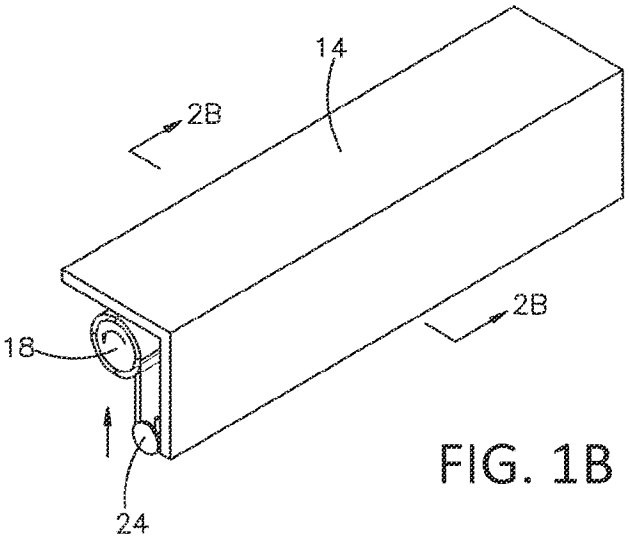
FIG. 1B is a perspective view of the example motorized transitional shade system shown in FIG. 1A, with the covering material in an open position, wherein the covering material is wound about the roller tube.
Figure 1A:
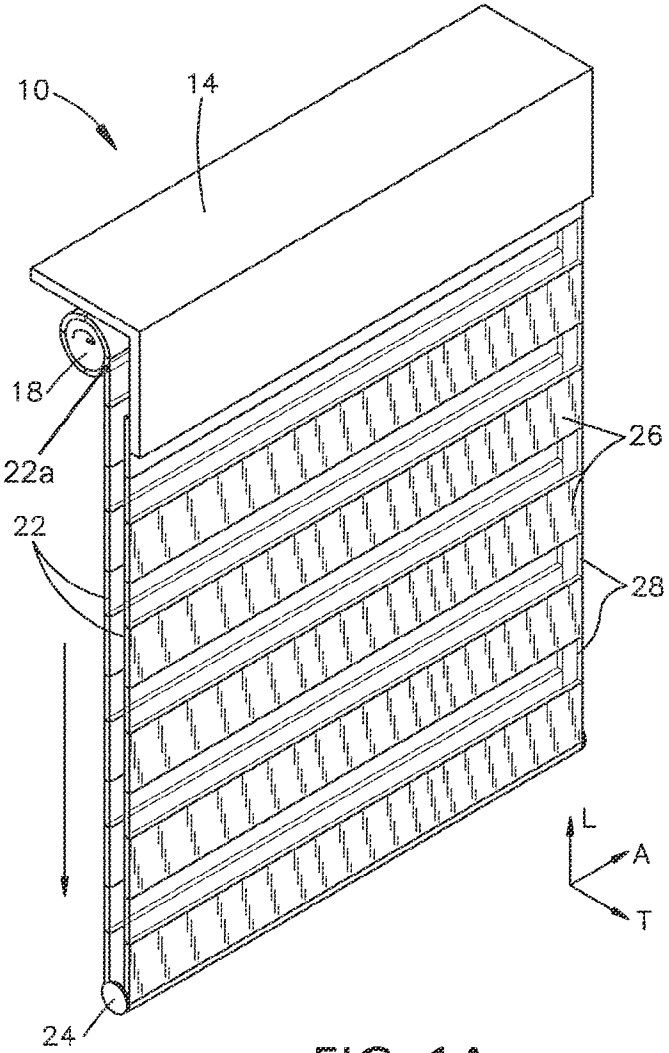
FIG. 1A is a perspective view of an example motorized transitional shade system that includes a housing, a roller tube that is rotatably mounted to the housing, a covering material having a first end that is windingly attached to the roller tube and a second end that is attached to the housing, and a bottom bar that is movably supported by the covering material, with the covering material in a closed position.

The motorized transitional shade system 10 may further include a covering material 22 (e.g., a transitional shade material) that is windingly attached to the roller tube 18, such that rotation of the roller tube 18 causes the covering material 22 to wind or unwind from the roller tube 18, and thereby to move between a closed position as shown in FIG. 1A, an open position as shown in FIG. 1B, one or more view positions, and one or more privacy positions, for instance as described herein. As shown, the covering material 22 defines a first end 22*a* that is windingly attached to the roller tube 18, and a second end 22*b* that is attached to the housing 14. The second end 22*b* of the covering material 22 may be attached in a fixed position relative to the housing 14. One or both of the housing 14 and the second end 22*b* of the covering material 22 may be configured such that the location at which the second end 22*b* of the covering material 22 is attached to the housing 14 is adjustable (e.g., upwardly and/or downwardly adjustable).

The motorized transitional shade system 10 may further include a bottom bar 24 that is configured to maintain the covering material 22 in tension (e.g., as the covering material 22 hangs vertically in front of or in an opening). The bottom bar 24 may be configured to be movably supported by the covering material 22, such that the bottom bar 24 moves freely along the covering material as the roller tube 18 rotates. For example, as shown, the bottom bar 24 may comprise a roller (e.g., a bottom roller), wherein the covering material 22 moves through the roller as the covering material 22 is moved to a desired position. As the motor drive unit 16 causes the roller tube 18 to rotate, the covering material 22 may wind onto or unwind from the roller tube 18, such that the bottom bar 24 moves along a longitudinal direction L toward or away from the roller tube 18 and the housing 14. The longitudinal direction L may be referred to as a first direction. As the covering material 22 is moved along the longitudinal direction L, for example as the covering material 22 is being unwound from or wound about the roller tube 18, the bottom bar 24 may ride along the covering material 22. It should be appreciated that the motorized transitional shade system 10 is not limited to the illustrated bottom bar 24, and that the bottom bar 24 may be alternatively configured, so long as the bottom bar 24 may freely move along the covering material 22 as the covering material 22 is moved. The bottom bar 24 may cause the covering material 22 to define a first portion 25*a* that extends from the roller tube 18 (e.g., at 22*a*) to the bottom bar 24, and a second portion 25*b* that extends from the bottom bar 24 to the second end 22*b* of the covering material 22. The second portion 25*b* may be spaced from the first portion 25*a* along a transverse direction T that is perpendicular to the longitudinal direction L. The transverse direction T may be referred to as a second direction.

The covering material 22 may be configured to impede visualization therethrough or to permit visualization therethrough, based on an amount of the covering material 22 that is wound about the roller tube 18. For example, as shown in FIGS. 1A and 2B-2C, the covering material 22 may define a plurality of opaque sections 26 and a plurality of transparent sections 28. The respective pluralities of opaque sections 26 and transparent sections 28 may be arranged in an alternating pattern along the covering material 22, for example between the first and second ends 22*a*, 22*b*. For instance, each opaque section 26 may be separated from an adjacent opaque section 26 along the longitudinal direction L by a transparent section 28, such that the transparent section 28 is disposed between the adjacent opaque sections 26. In accordance with the illustrated configuration of the covering material 22, the opaque sections 26 and transparent sections 28 define stripes that extend along a lateral direction A that is perpendicular to both the longitudinal direction L and the transverse direction T. The lateral direction A may be referred to as a third direction. As shown, the respective stripes of the opaque sections 26 and the transparent sections 28 extends across a width of the covering material (e.g., as defined between opposing edges of the covering material 22 along the lateral direction A). It should be appreciated that the covering material 22 is not limited to the illustrated pattern of opaque and transparent sections 26, 28, and that the covering material 22 may alternatively define any suitable pattern of opaque and transparent sections 26, 28. For example, each opaque section 26 may be separated from one or more adjacent opaque sections 26 along both the longitudinal direction L and the lateral direction A, for instance by one or more transparent sections 28.

The opaque sections 26 may be dimensioned the same or differently relative to each other, and the transparent sections 28 may be dimensioned the same or differently relative to each other. In accordance with the illustrated covering material 22, the opaque sections 26 are dimensioned the same relative to each other such that each opaque section 26 defines a first height H1 (e.g., measured along the longitudinal direction L), and the transparent sections 28 are dimensioned the same relative to each other, such that each transparent section 28 defines a second height H2H2 (e.g., measured along the longitudinal direction L). As shown, the first height H1 may be greater than the second height H2. It should be appreciated that the covering material 22 is not limited to the illustrated configuration of opaque and transparent sections 26, 28, and that the opaque sections 26 and transparent sections 28 may define any respective heights H1, H2. For example, the covering material 22 may be configured such that the first height H1 is substantially equal to the second height H2. It should be appreciated that, while the second end 22*b* of the covering material 22 defines an opaque section 26 that is attached to the housing 14 (e.g., as shown in FIGS. 2A-2C), that the second end 22*b* of the covering material 22 may alternatively define a partial opaque section 26, a transparent section 28, a partial transparent section 28, or the like, for example in accordance with a length of the covering material 22 (e.g., as defined by the first and second ends 22*a*, 22*b*).

Figure 2A:
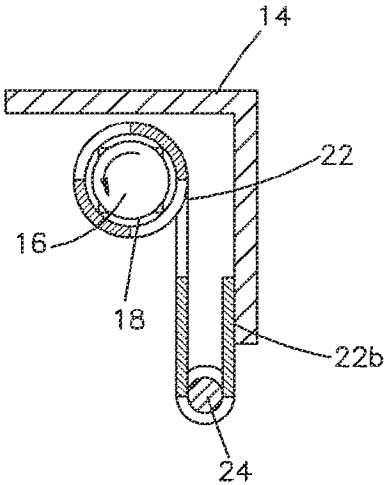
FIG. 2A depicts a cross-section of the example motorized transitional shade system shown in FIGS. 1A-1B, with the covering material in the open position.
Figure 2B:
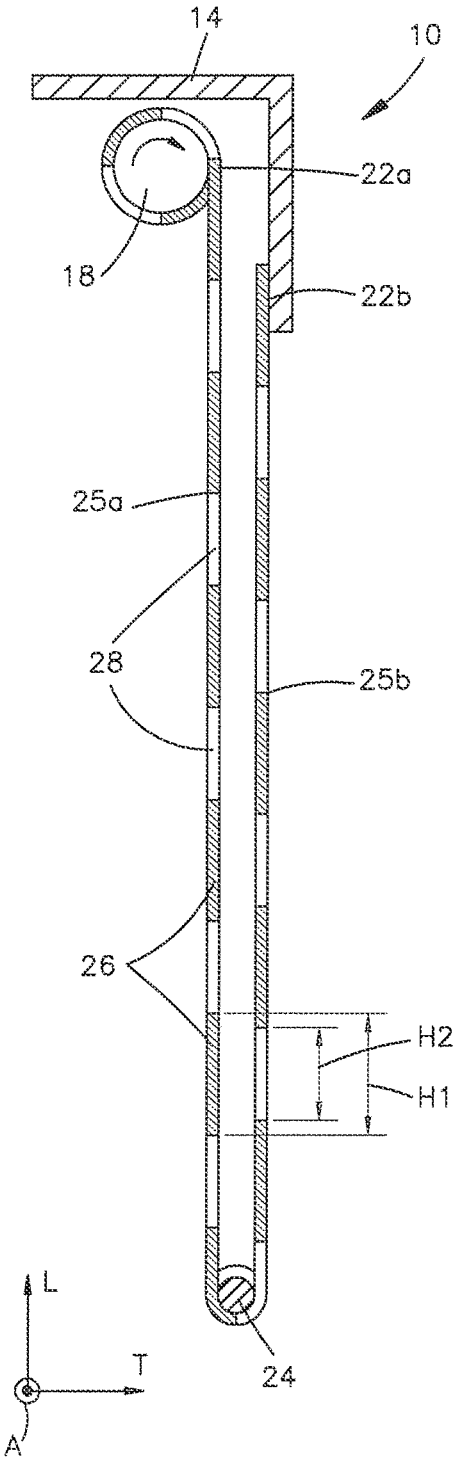
FIG. 2B depicts a cross-section of the example motorized transitional shade system shown in FIGS. 1A-1B, with the covering material in a privacy position, wherein visualization through the covering material is impeded.
Figure 2C:
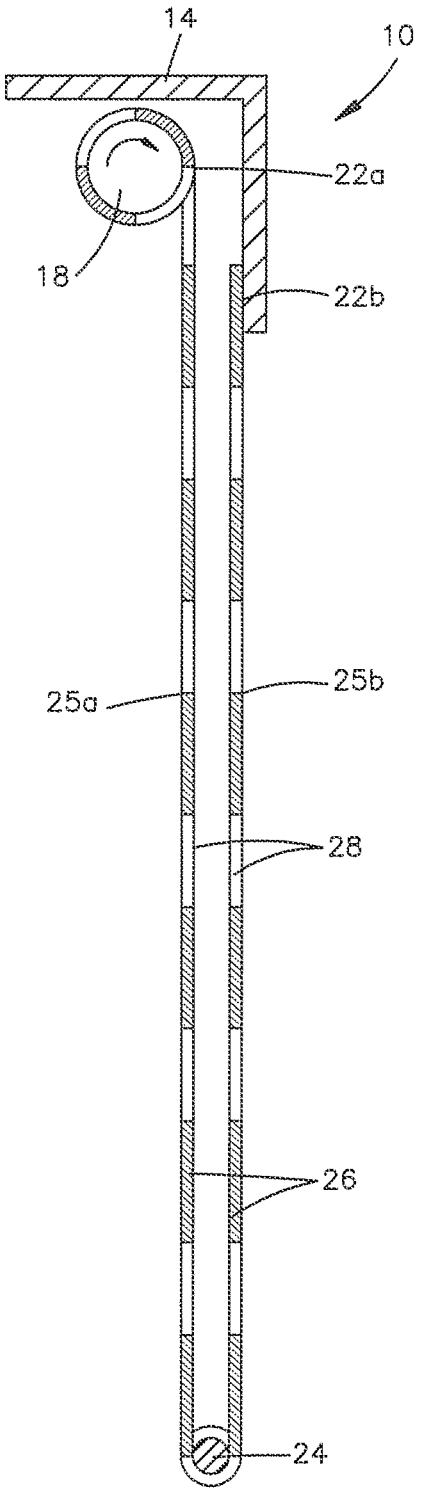
FIG. 2C depicts a cross-section of the example motorized transitional shade system shown in FIGS. 1A-1B, with the covering material in a view position, wherein visualization through the covering material is permitted.

As shown in FIG. 2A, the motor drive unit 16 may be mounted inside the housing 14 and at least partially within the roller tube 18. The motor drive unit 16 may be operatively coupled to the roller tube 18, such that the motor drive unit 16 may cause the roller tube 18 to rotate. The motor drive unit 16 may be configured to allow for control of the rotation of the roller tube 18 by a user of the motorized transitional shade system 10, so that the user may cause the bottom bar 24 to move along the longitudinal direction L and covering material 22 to move to a desired position. For example, the motor drive unit 16 may be operated to move the covering material 22 to an open position (e.g., as shown in FIG. 1B) wherein at least a portion of the covering material 22 is wound (e.g., substantially wound) about the roller tube 18, for example such that most of the length of the covering material 22 is wound about the roller tube 18. When the covering material 22 is in the open position, the bottom bar 24 may be disposed near an upper end of an opening that the motorized transitional shade system 10 is mounted in or in front of The motor drive unit 16 may be operated to move the covering material 22 to a closed position (e.g., as shown in FIG. 1A) wherein the covering material 22 is unwound (e.g., substantially unwound) from the roller tube 18, for example such that most of the length of the covering material 22 (e.g., as defined by the first and second ends 22*a*, 22*b*) is unwound about the roller tube 18. When the covering material 22 is in the closed position, the bottom bar 24 may be disposed near a lower end of an opening that the motorized transitional shade system 10 is mounted in or in front of, such that the covering material 22 covers the opening. For simplicity of illustration, the motor drive unit 16 is not shown inside of the roller tube 18 in FIGS. 1A, 1B, 2B, and 2C.

The motor drive unit 16 may be operated to move the covering material 22 to a privacy position (e.g., as shown in FIG. 2B), wherein one or more transparent sections 28 of the first portion 25*a* align (e.g., along the transverse direction T) with one or more opaque sections 26 of the second portion 25*b*, and/or one or more opaque sections 26 of the first portion 25*a* align (e.g., along the transverse direction T) with one or more transparent sections 28 of the second portion 25*b*, such that visualization through the covering material 22 is impeded. When the covering material 22 is in a privacy position, the greater height H1 of the opaque sections relative to height H2 of the transparent sections 28 may cause the opaque sections 26 of the first portion 25*a* and corresponding opaque sections 26 of the second portion 25*b* to at least partially overlap one another. This may ensure that visualization through the covering material 22 is impeded when the covering material is in a privacy position. The closed position may be a privacy position, such that when the covering material 22 is in the closed position, the covering material 22 covers the opening and visualization through the covering material 22 is impeded.

The motor drive unit 16 may be operated to move covering material 22 to a view position (e.g., as shown in FIG. 2C), wherein one or more transparent sections 28 of the first portion 25*a* align (e.g., along the transverse direction T) with one or more transparent sections 28 of the second portion 25*b*, and/or one or more opaque sections 26 of the first portion 25*a* align (e.g., along the transverse direction T) with one or more opaque sections 26 of the second portion 25*b*, such that visualization (e.g., partial visualization) through the covering material 22 is permitted. When then the covering material 22 is in a view position, overlap between transparent sections 28 of the first portion 25*a* and opaque sections 26 of the second portion, and overlap between opaque sections 26 of the first portion 25*a* and transparent sections 28 of the second portion 25*b* is preferably minimal or nonexistent, such that transparent sections 28 of the first portion 25*a* are substantially (e.g., perfectly) aligned with corresponding transparent sections 28 of the second portion 25*b*, and opaque sections 26 of the first portion 25*a* are substantially (e.g., perfectly) aligned with corresponding opaque sections 26 of the second portion 25*b*.

The motor drive unit 16 may be operated to move the covering material 22 to one or more, such as a plurality, of intermediate positions between the open and closed positions, for instance wherein the covering material 22 at least partially covers an opening. The covering material 22 may be configured such that one or more of the intermediate positions define respective intermediate privacy positions, wherein one or more transparent sections 28 of the first portion 25*a* align with one or more opaque sections 26 of the second portion 25*b*, and/or one or more opaque sections 26 of the first portion 25*a* align with one or more transparent sections 28 of the second portion 25*b*, such that visualization through the covering material 22 is impeded. The covering material 22 may be configured such that one or more of the intermediate positions define respective intermediate view positions, wherein one or more transparent sections 28 of the first portion 25*a* align with one or more transparent sections 28 of the second portion 25*b*, and/or one or more opaque sections 26 of the first portion 25*a* align with one or more opaque sections 26 of the second portion 25*b*, such that visualization (e.g., partial visualization) through the covering material 22 is permitted.

Figures 7A, 7B, 7C:
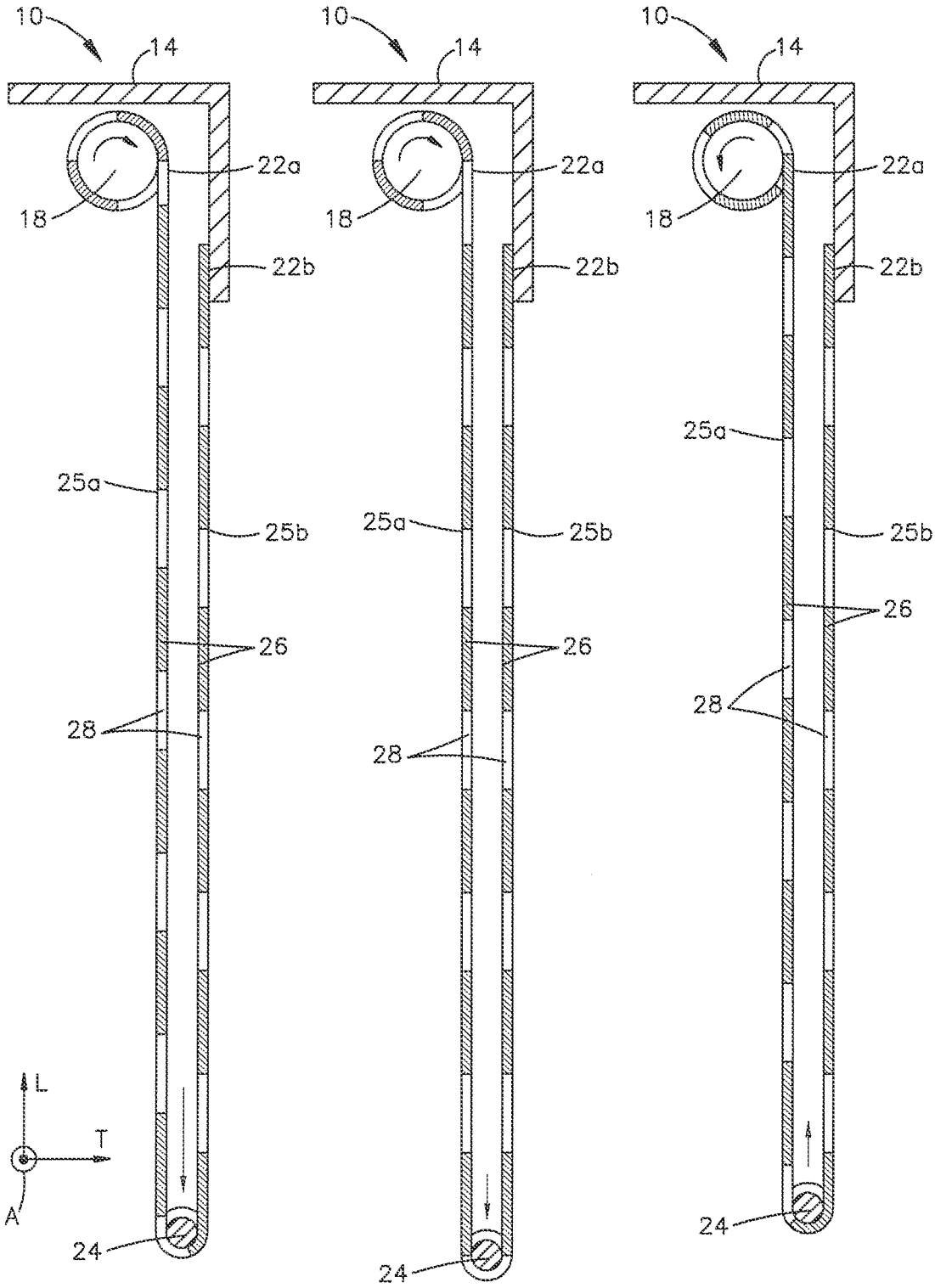
FIG. 7A depicts a cross-section of the example motorized transitional shade system shown in FIGS. 1A-1B, with the covering material in an intermediate position between the open and closed positions.
FIG. 7B depicts a cross-section of the example motorized transitional shade system shown in FIG. 7A, with the covering material moved from the intermediate position to a nearest view position.
FIG. 7C depicts a cross-section of the example motorized transitional shade system shown in FIG. 7A, with the covering material moved from the intermediate position to a nearest privacy position.

It should be appreciated that movement of the covering material 22 is not limited to moving the covering material 22 to view or privacy positions. For example, the covering material 22 may be moved to one or more intermediate positions between the open and closed positions that do not correspond to view or privacy positions, for instance such that opaque and transparent sections 26, 28 of the first portion 25*a* are out of alignment with (e.g., misaligned relative to) respective opaque or transparent sections 26, 28 of the second portion 25*b* (e.g., as shown in FIG. 7A).

The motorized transitional shade system 10 may be configured such that when the covering material 22 is in the closed position, the covering material 22 may substantially cover an opening such that the first and second portions 25*a* and 25*b* define a first length of the covering material 22, measured along the longitudinal direction L (e.g., from the first end 22*a* to the bottom bar 24 and from the bottom bar 24 to the second end 22*b*). The first length may be referred to as a maximum length of the covering material 22. When the covering material 22 is in such a closed position, opaque and transparent sections 26, 28 of the first portion 25*a* may be out of alignment with (e.g., misaligned relative to) respective opaque or transparent sections 26, 28 of the second portion 25*b*. In accordance with such a configuration of the motorized transitional shade system 10, a privacy position may be defined (e.g., set) wherein visualization through the covering material is impeded and the covering material defines a second length that is shorter than the first length, and/or a view position may be defined (e.g., set) wherein visualization through the covering material is permitted and the covering material defines a third length that is shorter than the first length. The third length may be longer or shorter than the second length. It should be appreciated that the maximum length is not necessarily an absolute maximum length that the covering material 22 is capable of having, but rather is the length that the first and second portions 25*a* and 25*b* have when the covering material is in the closed position.

The motor drive unit 16 may include one or more sensors that are configured to monitor the speed and/or position of the covering material 22, such that the motor drive unit 16 may maintain knowledge of a position of the covering material 22, for example relative to one or control limits, at any given time. The motor drive unit 16 may be configured to be controlled locally (e.g., via one or more buttons on the motor drive unit) and/or remotely (e.g., wirelessly via an infrared (IR) or radio frequency (RF) remote control device). The motor drive unit 16 may include an RF transceiver or receiver and an antenna that may be enclosed within the housing or coupled to an exterior portion of the housing. Examples of motor drive units for motorized roller shades are described in greater detail in U.S. Pat. No. 6,983,783, issued Jan. 10, 2006, entitled "Motorized Shade Control System," U.S. Pat. No. 7,723,939, issued May 25, 2010, entitled "Radio-Frequency Controlled Motorized Roller Shade," and U.S. Pat. No. 7,839,109, issued Nov. 23, 2010, entitled "Method Of Controlling A Motorized Window Treatment," the entire contents of each of which are incorporated herein by reference. It should be appreciated that the motorized transitional shade system 10 may be implemented with any motor drive unit 16 or drive system to control the roller tube 18.

Figure 3:
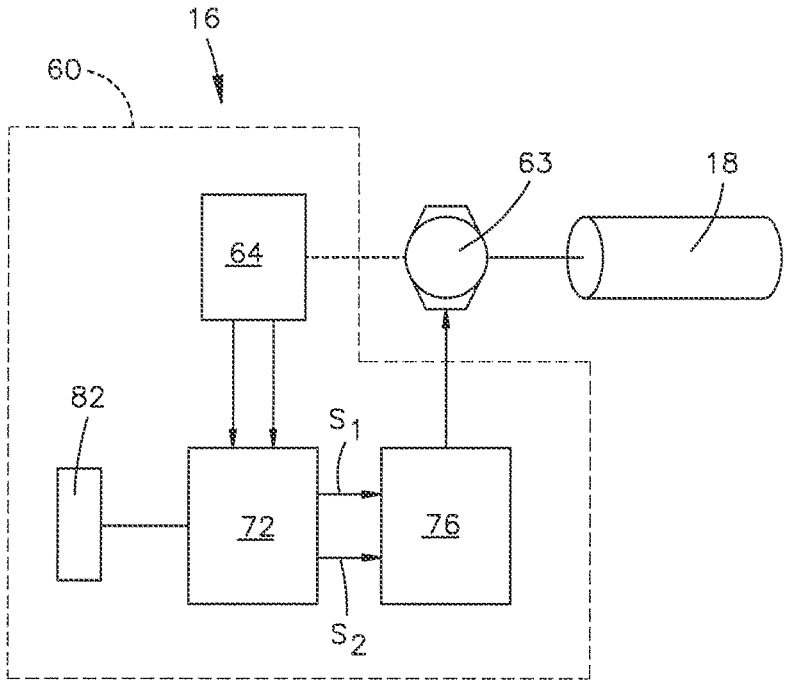
FIG. 3 is a simplified block diagram of an example motor drive unit that may be implemented in the example motorized transitional shade depicted in FIGS. 1A-1B.
Figure 4:
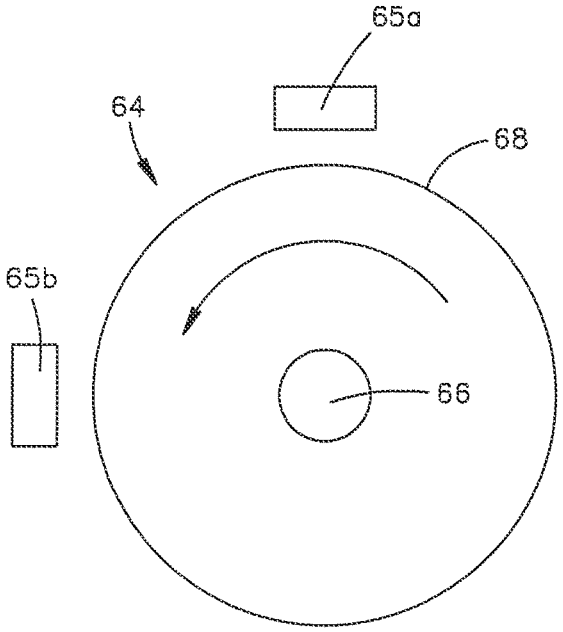
FIG. 4 is a partial schematic of a Hall effect sensor that may be included in the example motor drive unit depicted in FIG. 3.

With reference to FIGS. 3 and 4, the motorized transitional shade system 10, and in particular the motor drive unit 16, may further include a control system 60 that controls a motor 63 of the motor drive unit 16 to vary the rotational speed of the roller tube 18 as the covering material 22 is moved between positions, so that a speed (e.g., a linear speed) at which the bottom bar 24 moves along the longitudinal direction L is held constant. The control system 60 may configured to track a position of the covering material 22 as it is moved by the motor 63, and/or to track a position of the bottom bar 24 relative to the roller tube 18. For example, the control system 60 may include one or more sensors that are configured to track a position of the covering material 22 as it is moved by the motor 63, and/or to track a position of the bottom bar 24 relative to the roller tube 18.

As shown in FIG. 3, the control system 60 may include a position sensor, such as a Hall effect sensor assembly 64 (e.g., including a Hall effect sensor circuit) that is responsive to the motor 63 for providing information regarding rotational speed and/or rotational direction of an output shaft 66 of the motor 63. As shown in FIG. 4, the Hall effect sensor assembly 64 may include a sensor magnet 68 that is secured to the output shaft 66 and first and second Hall effect sensors 65*a*, 65*b* located adjacent a periphery of the sensor magnet 68. The first and second Hall effect sensors 65*a*, 65*b* provide output signals in the form of pulse trains, the frequency of which may be a function of the rotational speed of the output shaft 66 of the motor 63. The use of sensor devices to track the direction and speed of a motor is described in greater detail in U.S. Pat. No. 5,848,634, issued Dec. 15, 1998, entitled "Motorized Window Shade System," and U.S. Pat. No. 6,497,267, issued Dec. 24, 2002, entitled "Motorized Window Shade With Ultra Quiet Motor Drive And ESD Protection," the entire contents of each of which are incorporated herein by reference. It should be appreciated that the motorized transitional shade system 10 is not limited to the illustrated implementation of tracking the position of the covering material 22 with the Hall effect sensor assembly 64, and that the motorized transitional shade system 10 may be implemented with any suitable sensor, or sensors, to track the position of the covering material 22. For example, the control system 60 may include an optical sensor (e.g., a transmissive optical sensor) or a resistive position sensor.

As shown in FIG. 3, the control system 60 may further include a control circuit, such as a microprocessor 72, which may be communicatively connected to the Hall effect sensor assembly 64 to receive the pulse train signals generated by rotation of the output shaft 66. The microprocessor 72 may use the information regarding the rotation of the output shaft 66 to track the position of the covering material 22 as it is moved, and/or to track the position of the bottom bar 24 relative to the roller tube 18. The control system 60 may further include a memory 82 (e.g., an integrated circuit, RAM, ROM, etc.) that is communicatively connected to the microprocessor 72. The control system 60 may comprise a drive circuit for the motor 63, for example, an H-bridge drive circuit 76. The microprocessor 72 may be configured to drive the H-bridge drive circuit 76 to control the motor 63 using motor control signals S1 and S2. Control signal S1 may control the motor 63 to rotate the roller tube 18 in a first rotational direction or an opposed second rotational direction, and control signal S2 may control the motor 63 to vary the rotational speed of the roller tube 18. An example of a system for controlling roller tube rotational speed is described in greater detail in U.S. Pat. No. 7,281,565, issued Oct. 16, 2007, entitled "System For Controlling Roller Tube Rotational Speed For Constant Linear Shade Speed," the entire contents of which is incorporated herein by reference.

Figure 5:
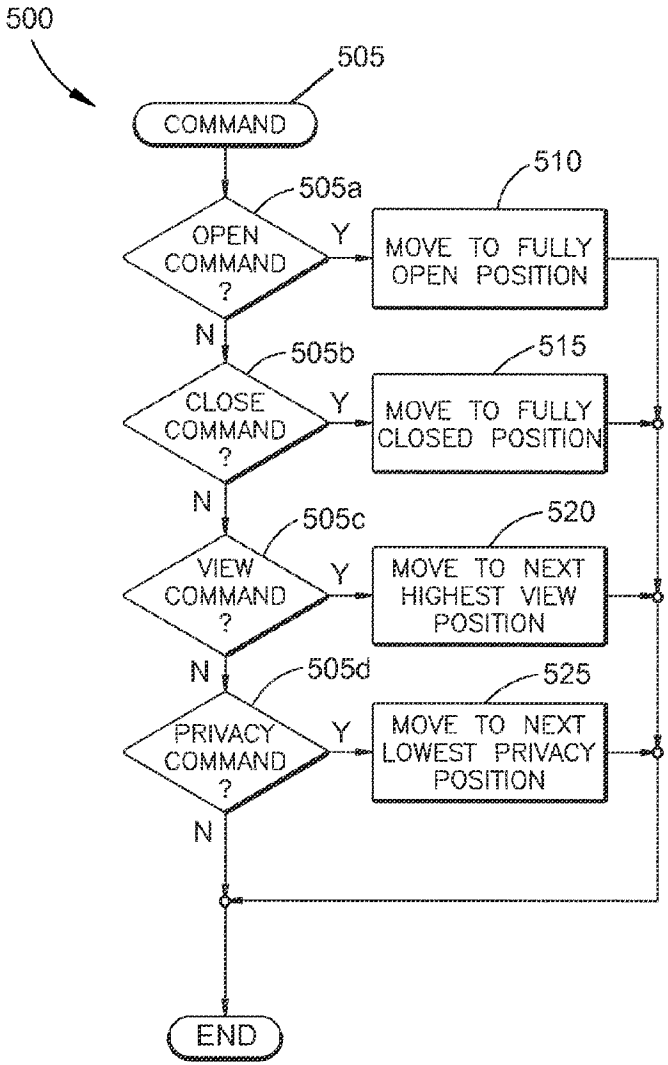
FIG. 5 is a flow diagram illustrating an example process for controlling a motorized transitional shade system.

FIG. 5 is a flow diagram illustrating an example process 500 for controlling a motorized transitional shade system, for example the motorized transitional shade system 10. One or more steps of the example process 500 may be encoded in a software and/or firmware routine that may be stored in the memory 82, and retrieved for execution by the microprocessor 72, for example. It should be appreciated that the example process 500 is not limited to implementation with the motorized transitional shade system 10. For example, the example process 500 may be implemented (e.g., as described or suitably adapted) for controlling other motorized shading systems.

The example process 500 may be performed during operation of the motorized transitional shade system 10. For example, the process 500 may be executed by the microprocessor 72 during movement of the covering material 22 (e.g., between open, closed, privacy, view, and intermediate positions).

At 505, a command to move the covering material 22 may be received by the motorized transitional shade system 10 (e.g., received by the control system 60). For example, the command may be received from a remote control device that is associated with the motorized transitional shade system 10. The command may be, for example, a preset command (e.g., a go-to command) associated with a particular position of the covering material 22, such as an open position, a closed position, one or more view positions, or one or more privacy positions. A preset command may be invoked, for example, by a user pressing and releasing a corresponding control, such as an open button, a close button, a view button, or a privacy button on a remote control device. As shown, the command may be, an open command 505*a*, a close command 505*b*, a view command 505*c*, a privacy command 505*d*, or any combination of these commands, or another command, for example. Upon receipt of a command, the microprocessor 72 may receive (e.g., read) a sensor input, for example an input from the Hall effect sensor assembly 64. The microprocessor 72 may determine a current position of the covering material 22, for example based on the sensor input. Any one of an open command 505*a*, a close command 505*b*, a view command 505*c*, or a privacy command 505*d*, may be initiated regardless of a current position of the covering material 22.

If the received command is an open command 505*a*, the microprocessor 72 may, at 510, control the motor drive unit 16 to begin rotating, to continue rotating, or to reverse the direction of rotation of, the roller tube 18, such that the covering material 22 moves from the current position toward the open position. For example, upon receiving an open command 505*a*, the microprocessor 72 may determine whether the covering material 22 is at the open position. The microprocessor 72 may compare the current position of the covering material 22 with the open position. If the current position of the covering material 22 does not match the open position, the microprocessor 72 may control the motor drive unit 16 to begin rotating the roller tube 18 to move the covering material toward the open position.

If the received command is a close command 505*b*, the microprocessor 72 may, at 515, control the motor drive unit 16 to begin rotating, to continue rotating, or to reverse the direction of rotation of, the roller tube 18, such that the covering material 22 moves from the current position toward the closed position. For example, upon receiving a close command 505*b*, the microprocessor 72 may determine whether the covering material 22 is at the closed position. The microprocessor 72 may compare the current position of the covering material 22 with the closed position. If the current position of the covering material 22 does not match the closed position, the microprocessor 72 may control the motor drive unit 16 to begin rotating the roller tube 18 to move the covering material toward the closed position. The closed position may further define a privacy position of the covering material 22 wherein one or more transparent sections 28 of the first portion 25*a* align with one or more opaque sections 26 of the second portion 25*b* and/or one or more opaque sections 26 of the first portion 25*a* align with one or more transparent sections 28 of the second portion 25*b*. Alternatively, the closed position may further define a view position of the covering material 22 wherein one or more transparent sections 28 of the first portion 25*a* align with one or more transparent sections 28 of the second portion 25*b* and/or one or more opaque sections 26 of the first portion 25*a* align with one or more opaque sections 26 of the second portion 25*b*. Alternatively still, the closed position may further define a position of the covering material 22 in which the opaque and transparent sections 26, 28 of the first portion 25*a* are misaligned relative to respective opaque or transparent sections 26, 28 of the second portion 25*b*.

If the received command is a view command 505*c*, the microprocessor 72 may, at 520, control the motor drive unit 16 to begin rotating, to continue rotating, or to reverse the direction of rotation of, the roller tube 18, such that the covering material 22 moves from the current position toward a predetermined view position, such as a nearest view position. The nearest view position may be a next highest view position, for example. A next highest view position may be, for example, a position of the covering material 22 that requires movement of the covering material 22 from the current position upward (e.g., toward the open position) to a next position in which one or more transparent sections 28 of the first portion 25*a* align with one or more transparent sections 28 of the second portion 25*b* and/or one or more opaque sections 26 of the first portion 25*a* align with one or more opaque sections 26 of the second portion 25*b*. The nearest view position may be, for example, a position of the covering material 22 that requires the least amount of rotation of the roller tube 18 to move the covering material 22 from the current position to a position in which one or more transparent sections 28 of the first portion 25*a* align with one or more transparent sections 28 of the second portion 25*b* and/or one or more opaque sections 26 of the first portion 25*a* align with one or more opaque sections 26 of the second portion 25*b*.

Upon receiving a view command 505*c*, the microprocessor 72 may compare the current position of the covering material 22 with one or more (e.g., a plurality of) view positions, and may control the motor drive unit 16 to begin rotating the roller tube 18 to move the covering material 22 toward a nearest view position, such as a next highest view position of the covering material 22. Alternatively, the microprocessor 72 may be configured to, upon receiving a view command 505*c*, move the covering material 22 downward toward a next lowest view position (e.g., such that the bottom bar 24 moves away from the roller tube 18).

If the received command is a privacy command 505*d*, the microprocessor 72 may, at 525, control the motor drive unit 16 to begin rotating, to continue rotating, or to reverse the direction of rotation of, the roller tube 18, such that the covering material 22 moves from the current position toward a predetermined privacy position, such as a nearest privacy position. The nearest privacy position may be a next lowest view position, for example. A next lowest privacy position may be, for example, a position of the covering material 22 that requires movement of the covering material 22 from the current position downward (e.g., towards the closed position) to a next position in which one or more transparent sections 28 of the first portion 25*a* align with one or more opaque sections 26 of the second portion 25*b* and/or one or more opaque sections 26 of the first portion 25*a* align with one or more transparent sections 28 of the second portion 25*b*. The nearest privacy position may be, for example, a position of the covering material 22 that requires the least amount of rotation of the roller tube 18 to move the covering material 22 from the current position to a position in which one or more transparent sections 28 of the first portion 25*a* align with one or more opaque sections 26 of the second portion 25*b* and/or one or more opaque sections 26 of the first portion 25*a* align with one or more transparent sections 28 of the second portion 25*b*.

Upon receiving a privacy command 505*d*, the microprocessor 72 may compare the current position of the covering material 22 with one or more (e.g., a plurality of) privacy positions, and may control the motor drive unit 16 to begin rotating the roller tube 18 to move the covering material 22 toward a nearest privacy position, such as a next lowest privacy position of the covering material 22. Alternatively, the microprocessor 72 may be configured to, upon receiving a privacy command 505*d*, move the covering material 22 upward toward a next highest privacy position (e.g., such that the bottom bar 24 moves toward the roller tube 18).

The command may be other than a preset command. For example, the command may be a fine tune command, a stop command, or another command. A fine tune command may be associated with moving the covering material 22 in a specific direction. For example, a fine tune command may be associated with moving the covering material 22 upward such that the bottom bar 24 moves toward the roller tube 18, or downward such that the bottom bar 24 moves away from the roller tube 18. A fine tune command may be invoked, for example, by a user pressing and releasing, or pressing and holding, a corresponding control, such as a raise button or a lower button on the motorized transitional shade system 10 or on a remote control device. A fine tune command may be associated with causing the motor 63 to rotate the roller tube 18 such that a portion of the covering material 22 is wound onto, or unwound from, the roller tube 18. The portion of the covering material 22 may correspond to a fraction of the length of the covering material 22, such as an eighth of the length, a quarter of the length, half of the length, or any other fraction of the length of the covering material 22. Such a fine tune command may be invoked, for example, by pressing and releasing a raise button or a lower button. A fine tune command may further cause the motor 63 to continuously rotate the roller tube 18, such that the covering material 22 is wound onto, or unwound from, the roller tube 18, for example while a raise button or a lower button is pressed and held in a depressed position. Once the raise or lower button is released, the motor 63 may cease rotating the roller tube 18.

A stop command may be associated with stopping movement of the covering material 22. For example, the receipt of a command that is the same or different from a currently executing command may be interpreted (e.g., by the microprocessor 72) as a stop command. To illustrate, if a preset command is received and a subsequent, interrupting command is received before execution of the preset command is completed, the interrupting command may be interpreted as a stop command, such that movement of the covering material 22 is halted upon receipt of the interrupting command. A stop command may be generated, for example by the microprocessor 72, when a fine tune command ends (e.g., when a user releases a raise button or a lower button). The motorized transitional shade system 10 may include a designated stop control, for example a stop button on a remote control device. Such a stop button may supplement, or replace, the interpretation of an interrupting command as a stop command and/or the generation of a stop command at the end of a fine tune command.

The motorized transitional shade system 10 may be operated to move the covering material 22 between the open and closed positions (e.g., to one or more intermediate positions), such that the bottom bar 24 is located at any number of positions between the closed and open positions and the covering material 22 partially covers an opening that the motorized transitional shade system 10 is mounted in or in front of The covering material 22 may define one or more (e.g., a plurality) of view positions between the open and closed positions, which may be referred to as intermediate view positions, and may define one or more (e.g., a plurality) of privacy positions between the open and closed positions, which may be referred to as intermediate privacy positions. If the closed position of the covering material further defines a privacy position of the covering material 22, one or more intermediate privacy positions may be referred to as intermediate closed positions.

Figure 6:
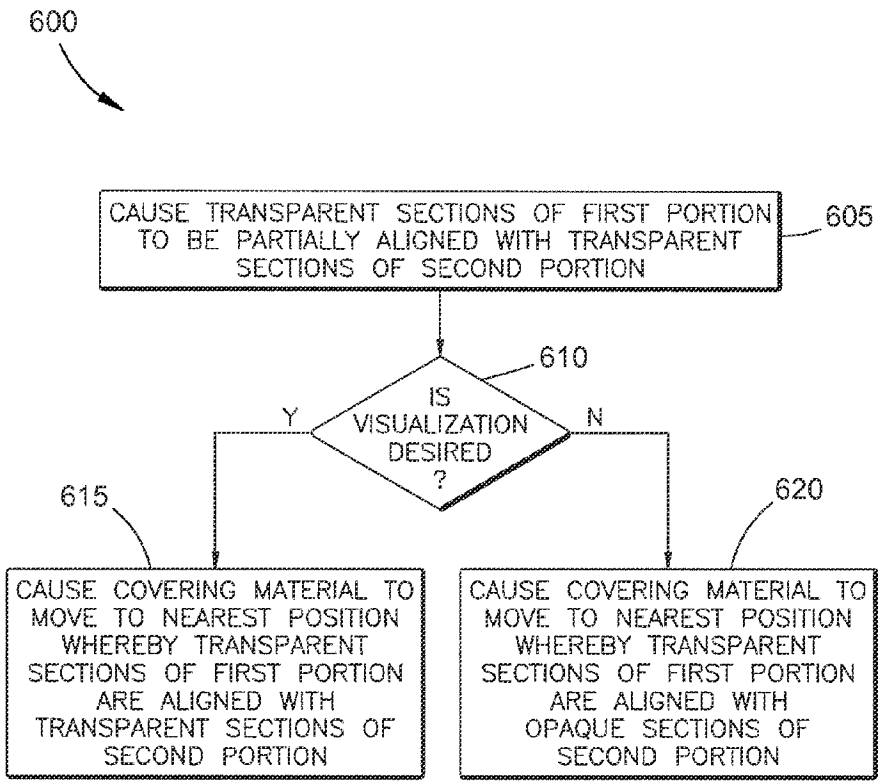
FIG. 6 is a flow diagram illustrating another example process for controlling a motorized transitional shade system.

The motorized transitional shade system 10 may be configured to automatically adjust the position of the covering material 22 when movement of the covering material 22 is halted with the covering material 22 in an intermediate position. FIG. 6 is a flow diagram illustrating another example process 600 for controlling a motorized transitional shade system, for example the motorized transitional shade system 10. One or more steps of the example process 600 may be encoded in a software and/or firmware routine that may be stored in the memory 82, and retrieved for execution by the microprocessor 72, for example. It should be appreciated that the example process 600 is not limited to implementation with the motorized transitional shade system 10. For example, the example process 600 may be implemented (e.g., as described or suitably adapted) for controlling other motorized shading systems.

At 605, the covering material 22 may be moved to, and halted at, an intermediate position wherein the opaque and transparent sections 26, 28 of the first portion 25*a* are misaligned relative to respective opaque or transparent sections 26, 28 of the second portion 25*b* (e.g., as shown in FIG. 7A). Such a position may be referred to as a misaligned intermediate position of the covering material 22. For example, the covering material 22 may be moved to an intermediate position responsive to a fine tune command. To illustrate, a user of the motorized transitional shade system 10 may cause the covering material 22 to move to the intermediate position by actuating a control (e.g., a raise button) that causes the roller tube 18 to move the covering material upward such that the bottom bar 24 moves toward the roller tube 18, or may cause the covering material 22 to move to the intermediate position by actuating a control (e.g., a lower button) that causes the roller tube 18 to move the covering material downward such that the bottom bar 24 moves away from the roller tube 18.

At 610, the microprocessor 72 may determine whether visualization is desired. Whether visualization is desired when movement of the covering material 22 is halted with the covering material 22 in a misaligned intermediate position may be determined, for example, in accordance with a predetermined indication, such as a default setting that is stored in the memory 82. Such a setting may be set at a time of manufacture of the motorized transitional shade system 10, may be set at a time of installation of the motorized transitional shade system 10, and/or may be updated by a user of the motorized transitional shade system 10 at any time. For example, the microprocessor 72 may be configured to determine that visualization is desired at 610 if, for example, the covering material 22 was moving upward toward the open position before the covering material 22 was moved to and halted at the intermediate position, and/or may be configured to determine that visualization is not desired at 610 if, for example, the covering material 22 was moving downward towards the closed position before the covering material 22 was moved to and halted at the intermediate position.

At 615, if the microprocessor 72 determines that visualization is desired, the microprocessor 72 may cause the roller tube 18 to move the covering material to a view position (e.g., a nearest view position), wherein one or more transparent sections 28 of the first portion 25*a* align with one or more transparent sections 28 of the second portion 25*b*, and/or one or more opaque sections 26 of the first portion 25*a* align with one or more opaque sections 26 of the second portion 25*b*, such that visualization through the covering material 22 is permitted. For example, the microprocessor 72 may be configured to automatically move the covering material 22 upward toward a next highest view position or may be configured to automatically move the covering material 22 downward toward a next lowest view position.

At 620, if the microprocessor 72 determines that visualization is not desired, the microprocessor 72 may cause the roller tube 18 to move the covering material to a privacy position (e.g., a nearest view position), wherein one or more transparent sections 28 of the first portion 25*a* align with one or more opaque sections 26 of the second portion 25*b*, and/or one or more opaque sections 26 of the first portion 25*a* align with one or more transparent sections 28 of the second portion 25*b*, such that visualization through the covering material 22 is impeded. For example, the microprocessor 72 may be configured to move the covering material 22 downward toward a next lowest privacy position or may be configured to move the covering material 22 upward toward a next highest privacy position.

It should be appreciated that the motorized transitional shade system 10 is not limited to automatically adjusting the position of the covering material 22 in accordance with a static preference setting. The microprocessor 72 may be configured to, for example, learn whether a user prefers a view position or a privacy position when movement of the covering material 22 is halted with the covering material 22 in an intermediate position. To illustrate, the microprocessor 72 may be configured to determine whether a user repetitively controls the motorized transitional shade system 10 to a view position or a closed position after the covering material 22 was moved to and halted at an intermediate position, and then store that desired visualization setting (e.g., in the memory 82). In this regard, the motorized transitional shade system 10 may be configured to dynamically update the desired visualization setting.

Figure 8:
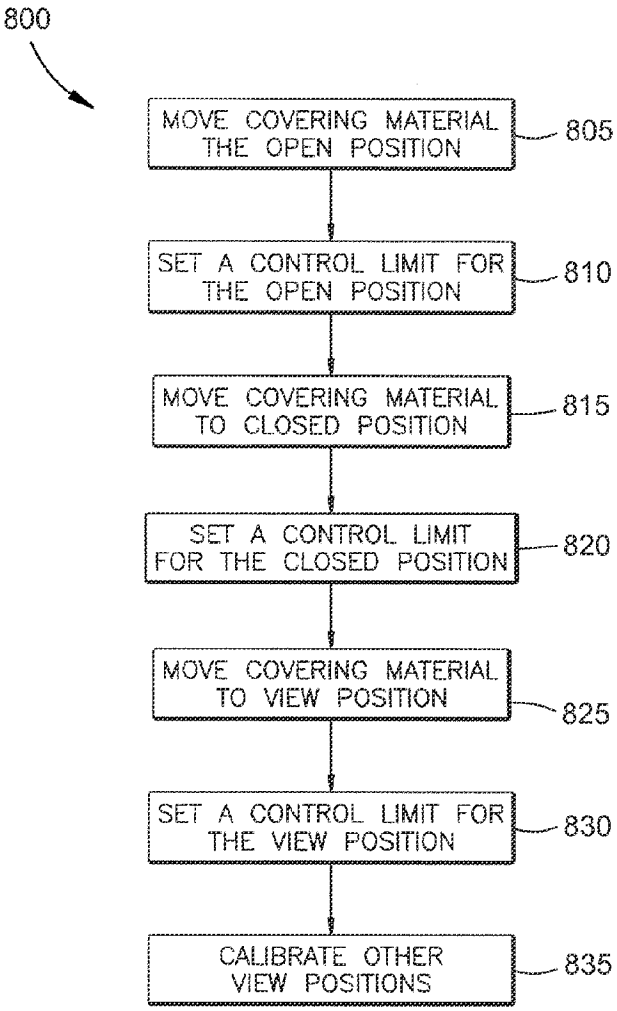
FIG. 8 is a flow diagram illustrating an example process for setting control limits of a motorized transitional shade system.

FIG. 8 is a flow diagram illustrating an example process 800 for setting control limits of a motorized transitional shade system, such as the motorized transitional shade system 10. The process 800 may be performed, for example, when the motorized transitional shade system 10 is mounted to structure (e.g., proximate to an opening such as a window). One or more steps of the example process 800 may be encoded in a software and/or firmware routine that may be stored in the memory 82, and retrieved for execution by the microprocessor 72, for example. It should be appreciated that the example process 800 is not limited to implementation with the motorized transitional shade system 10. For example, the example process 800 may be implemented (e.g., as described or suitably adapted) for setting limits of other motorized shading systems.

At 805, the covering material 22 may be moved to the open position. The covering material 22 may be moved, for example, by a user operating the motor 63 to rotate the roller tube 18 (e.g., by the user pressing a button on the motor drive unit 16 or a button on a remote control device). In this regard, the user may manually determine the open position. At 810, once the covering material 22 is in the open position, a control limit for the open position of the covering material 22 may be set or otherwise programmed In accordance with the example process 800, the control limit for the open position may be referred to as a first control limit of the motorized transitional shade system 10. The control limit for the open position may be stored in terms of rotation (e.g., a number of rotations) of the roller tube 18. For example, the control limit for the open position may be stored in response to pressing a button on the motor drive unit 16 or a button on a remote control device that controls the operation of the motor drive unit 16, for instance when the covering material 22 is positioned at the open position. Pressing the button may cause the microprocessor 72 to store the control limit for the open position, for example in the memory 82.

At 815, the motor 63 may be operated (e.g., by a user) to move the covering material 22 from the open position to the closed position (e.g., by the user pressing a button on the motor drive unit 16 or a button on a remote control device). In this regard, the user may manually determine the closed position. At 820, once the covering material 22 is in the closed position, a control limit for the closed position of the covering material 22 may be set or otherwise programmed, for example in response to pressing a button on the motor drive unit 16 or a button on the remote control device that controls the operation of the motor drive unit 16. In accordance with the example process 800, the control limit for the closed position may be referred to as a second control limit of the motorized transitional shade system 10.

At 825, the motor 63 may be operated (e.g., by a user) to move the covering material 22 from the closed position to a view position, such as an intermediate view position (e.g., by the user pressing a button on the motor drive unit 16 or a button on a remote control device). The view position may be, for example, a lowest view position that the covering material 22 is capable of reaching. The bottom bar 24 may be located closer to the roller tube 18 when the covering material 22 is in the lowest view position than when the covering material 22 is in the closed position, for example if the closed position further defines a privacy position. At 830, once the covering material 22 is in desired view position, a control limit for the view position of the covering material 22 may be set or otherwise programmed, for example in response to pressing a button on the motor drive unit 16 or a button on the remote control device that controls the operation of the motor drive unit 16. In accordance with the example process 800, the control limit for the view position may be referred to as a third control limit of the motorized transitional shade system 10.

At 835, one or more other view and/or privacy positions of the covering material 22 may be set. For example, a control limit that corresponds to a privacy position may be set. Such a privacy position may correspond to a lowest privacy position that the covering material 22 is capable of reaching. The bottom bar 24 may be located closer to the roller tube 18 when the covering material 22 is in the lowest privacy position than when the covering material 22 is in the closed position, for example if the closed position further defines a view position. One or more intermediate view and/or intermediate closed positions may be set at 835. The control limit for the lowest privacy position may be referred to as a fourth control limit of the motorized transitional shade system 10. It should be appreciated that the example process 800 is not limited to the illustrated order of setting limits for the motorized transitional shade system 10, and that the same or different control limits may be set in any desired order.

While the example process 800 illustrates manually setting control limits for various positions of the covering material 22, it should be appreciated that one or more positions of the covering material 22 (e.g., open, closed, view, or privacy positions) may be automatically determined (e.g., by the microprocessor 72), for instance based at least partially on respective control limits for one or more other positions, may be learned by the microprocessor 72 based on one or more user-determined positions (e.g., set by halting movement of the covering material 22 in an intermediate position), or the like. For example, control limits that correspond to one or more positions of the covering material 22 may be automatically determined based at least partially on one or more of the length of the covering material 22, a thickness of the covering material 22, a diameter of the roller tube 18, the height H1 of the opaque sections 26, or the height H2H2 of the transparent sections 28. The microprocessor 72 may be configured to automatically determine the location of the bottom bar 24 along the longitudinal direction L, relative to rotations of the roller tube 18, and may be configured to track movement of the covering material 22 relative to rotations of the roller tube 18. The microprocessor 72 may be further configured to automatically determine respective control limits that correspond to one or more positions of the covering material 22, based at least partially on rotation (e.g., revolutions or incremental revolutions) of the roller tube 18. It should be appreciated that the example process 800 may further include the automatic determination of one or more control limits (e.g., all the control limits) that correspond to positions of the covering material 22, for example in lieu of manually determining the one or more control limits.

When the corresponding control limits are set, one or more of positions of the covering material 22 (e.g., open, closed, view, privacy, intermediate view, or intermediate privacy) may be stored in the memory 82. One or more of the positions may be configured as presets on a remote control device, such that a user may quickly cause the covering material 22 to move to those positions, for example responsive to the press of a button. For example, the motorized transitional shade system 10 may include a remote control device that is configured to communicate with the control system 60 (e.g., with the microprocessor 72).

Figure 9:
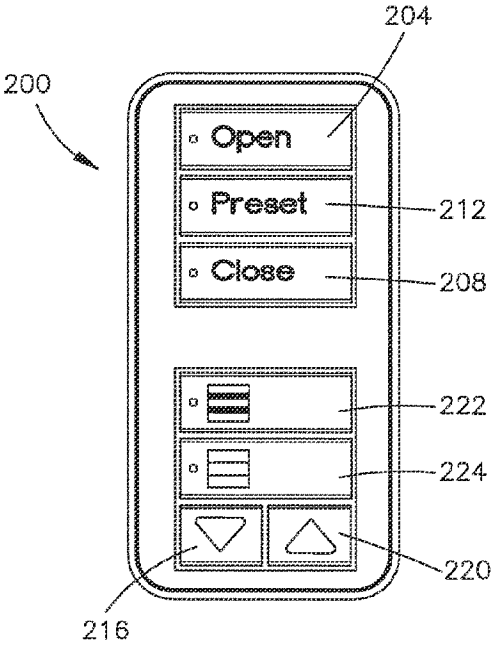
FIG. 9 is a front view of an example remote control device for controlling a motorized transitional shade system.

FIG. 9 depicts an example remote control device 200 that may be used to control the motorized transitional shade system 10. As shown, the remote control device 200 includes a first preset button 204 that is associated with the open position of the covering material 22, a second preset button 208 that is associated with the closed position of the covering material 22, a third preset button 222 that is associated with a view position of the covering material 22, and a fourth preset button 224 that is associated with a privacy position of the covering material 22. The remote control device 200 may optionally include a fifth preset button 212 that may user-programmable to be associated with an intermediate position of the covering material 22 (e.g., an intermediate view position or an intermediate privacy position).

The remote control device 200 may further include a lower button 216 that may be configured to cause the motor 63 to lower the covering material 22 and a raise button 220 that may be configured to cause the motor 63 to raise the covering material 22. Pressing the lower button 216 or the raise button 220 may cause the remote control device 200 to transmit a corresponding command to the control system 60 (e.g., a corresponding fine tune command).

Pressing the first preset button 204 may cause the remote control device 200 to transmit an open command 505*a* (e.g., to the control system 60), which may cause the motorized transitional shade system 10 to move the covering material 22 to the open position. Pressing the second preset button 208 may cause the remote control device 200 to transmit a close command 505*b*, which may cause the motorized transitional shade system 10 to move the covering material 22 to the closed position.

Pressing the third preset button 222 may cause the remote control device 200 to transmit a view command 505*c*. The motorized transitional shade system 10 may be configured such that the view command 505*c* causes the covering material 22 to move to a view position associated with a view control limit, or causes the covering material 22 to move to a nearest view position, such as a next highest view position. Pressing the fourth preset button 224 may cause the remote control device 200 to transmit a privacy command 505*d*. The motorized transitional shade system 10 may be configured such that the privacy command 505*d* causes the covering material 22 to move to a privacy position associated with a privacy control limit, or causes the covering material 22 to move to a nearest privacy position, such as a next lowest privacy position. In this regard, if a user moves the covering material 22 upward with the raise button 220, or moves the covering material 22 downward with the lower button 216, the user may stop moving the covering material 22 (e.g., by releasing the raise button 220 or the lower button 216), and then may press either the third preset button 222 to move the covering material 22 to a view position, or the fourth preset button 224 to move the covering material 22 to a privacy position.

The remote control device 200 may configured such that, if one of the first preset button 204, the second preset button 208, the third preset button 222, the fourth preset button 224, the fifth preset button 212, the lower button 216, or the raise button 220 is pressed before an operation that is associated with a currently executing command (e.g., a preset command) is completed, the remote control device 200 may transmit a command (e.g., a stop command), such that the operation associated with the currently executing command is interrupted and/or stopped (e.g., such that movement of the covering material 22 is halted).

One or both of the lower button 216 and the raise button 220 may be configured such that when the buttons are continuously depressed, the covering material 22 continues to lower or raise, respectively, as the button is held depressed. The control system 60 may be configured such that the covering material 22 stops at one or more control limits previously set or otherwise determined, even if the respective button is still being depressed.

It should be appreciated that the microprocessor 72 may be configured to control the motor drive unit 16 to rotate the roller tube 18, so as to wind the covering material 22 onto the roller tube 18, or to unwind the covering material 22 from the roller tube 18, such that the covering material 22 may be moved to a desired position. For example, the microprocessor 72 may cause the roller tube 18 to move the covering material 22 in response to input that is received by the microprocessor 72 (e.g., from the remote control device 200 or a control on the motor drive unit 16). The input may be processed according to instructions stored in the memory 82, and the microprocessor 72 may subsequently provide instructions to the motor 63. In this regard, the microprocessor 72 may be configured to control the motor 63 to rotate the roller tube 18 to move the covering material 22 to a desired position.

It should further be appreciated that the remote control device 200 is not limited to the illustrated configuration, such as the number of buttons or functions associated therewith, and that the remote control device 200 may alternatively have any configuration and may have any number of buttons configured to perform any function. For example, the remote control device 200 may alternatively include one or more additional buttons, such as a button associated with an intermediate view position or an intermediate privacy position (e.g., as described herein). It should further still be appreciated that the motorized transitional shade system 10 may be void of a remote control device 200.

The invention claimed is:

1. A motorized shade system comprising:

a housing;

a roller tube that is rotatably supported by the housing;

a covering material having a first end that is windingly attached to the roller tube and a second end that is attached to the housing, the covering material defining respective pluralities of opaque and transparent sections that are arranged in an alternating pattern between the first and second ends;

a bottom bar that is configured to be movably supported by the covering material, such that a first portion of the covering material extends from the roller tube to the bottom bar and a second portion of the covering material extends from the bottom bar to the second end; and a motor drive unit that includes a motor that is operatively coupled to the roller tube and a control system that is configured to cause the motor to move the covering material to an open position in which the bottom bar is disposed near an upper end of an opening and a portion of the covering material is wound about the roller tube, a closed position in which the bottom bar is disposed near a lower end of the opening such that the covering material covers the opening, a plurality of privacy positions in which visualization through the covering material is impeded, and a plurality of view positions in which visualization through the covering material is permitted, wherein the control system is further configured to:

upon receipt of a first command from a remote control device that is associated with the motorized shade system, cause the motor to rotate the roller tube to move the covering material;

upon receipt of a second command from the remote control device, cause the motor to halt rotation of the roller tube with the covering material at an intermediate position that is between the open and closed positions; and automatically cause the motor to rotate the roller tube to move the covering material from the intermediate position to one of the plurality of privacy positions or one of the plurality of view positions.

2. The motorized shade system of claim 1, wherein the intermediate position is between a particular one of the plurality of privacy positions and a particular one of the plurality of view positions that is adjacent to the particular one of the plurality of privacy positions.

3. The motorized shade system of claim 2, wherein the-control system is further configured to, when controlling the motor to move the covering material such that the bottom bar moves toward the closed position and rotation of the roller tube is halted with the covering material at the intermediate position, automatically cause the motor to rotate the roller tube to move the covering material from the intermediate position to the particular one of the plurality of privacy positions, wherein a transparent section in the first portion of the covering material aligns with an opaque section in the second portion of the covering material.

4. The motorized shade system of claim 1, wherein the control system is further configured to, when controlling the motor to move the covering material such that the bottom bar moves toward the closed position and rotation of the roller tube is halted with the covering material at the intermediate position, automatically cause the motor to rotate the roller tube to move the covering material from the intermediate position such that the bottom bar moves downward away from the roller tube until a transparent section in the first portion of the covering material aligns with an opaque section in the second portion of the covering material.

5. The motorized shade system of claim 2, wherein the control system is further configured to, when controlling the motor to move the covering material such that the bottom bar moves toward the open position and rotation of the roller tube is halted with the covering material at the intermediate position, automatically cause the motor to rotate the roller tube to move the covering material from the intermediate position to the particular one of the plurality of view positions, wherein a transparent section in the first portion of the covering material aligns with a transparent section in the second portion of the covering material.

6. The motorized shade system of claim 1, wherein the control system is further configured to, when controlling the motor to move the covering material such that the bottom bar moves toward the open position and rotation of the roller tube is halted with the covering material at the intermediate position, automatically cause the motor to rotate the roller tube to move the covering material from the intermediate position such that the bottom bar moves upward toward the roller tube until a transparent section in the first portion of the covering material aligns with a transparent section in the second portion of the covering material.

7. The motorized shade system of claim 1, wherein each opaque section comprises an opaque stripe that extends across a width of the covering material, and each transparent section comprises a transparent stripe that extends across the width of the covering material.

8. The motorized shade system of claim 1, wherein each opaque section defines a first height, and each transparent section defines a second height that is shorter than the first height.

9. The motorized shade system of claim 1, wherein the bottom bar comprises a roller that rides along the covering material as the covering material is moved.

10. The motorized shade system of claim 1, wherein when the covering material is in each of the plurality of privacy positions, at least one transparent section in the first portion of the covering material aligns with at least one opaque section in the second portion of the covering material.

11. The motorized shade system of claim 1, wherein when the covering material is in each of the plurality of view positions, at least one transparent section in the first portion of the covering material aligns with at least one transparent section in the second portion of the covering material.

12. The motorized shade system of claim 1, wherein when the covering material is in the closed position, the bottom bar is spaced further from the roller tube than when the covering material is in a position that corresponds to a view control limit.

13. A method of controlling a shade system that includes a housing, a roller tube that is rotatably supported by the housing, a covering material having a first end that is windingly attached to the roller tube and a second end that is attached to the housing, and a motor that is operably coupled to the roller tube, the method comprising:

upon receipt of a first command issued by a control device that is associated with the shade system, causing the motor to rotate the roller tube to move the covering material toward one of a plurality of preset positions of the covering material;

upon receipt of a second command issued by the control device, causing the motor to halt rotation of the roller tube with the covering material at an intermediate position that is between an open position of the covering material and a closed position of the covering material;

determining whether visualization through the covering material is desired; and if visualization through the covering material is not desired, automatically causing the motor to rotate the roller tube to move the covering material to a privacy position wherein visualization through the covering material is impeded; or if visualization through the covering material is desired, automatically causing the motor to rotate the roller tube to move the covering material to a view position wherein visualization through the covering material is permitted.

14. The method of claim 13, wherein the covering material defines respective pluralities of opaque and transparent sections that are arranged in an alternating pattern between the first and second ends.

15. The method of claim 14, wherein the shade system further includes a bottom bar that is configured to be movably supported by the covering material, such that a first portion of the covering material extends from the roller tube to the bottom bar and a second portion of the covering material extends from the bottom bar to the second end.

16. The method of claim 15, wherein moving the covering material to the privacy position comprises causing the motor to rotate the roller tube such that the bottom bar moves downward away from the roller tube until a transparent section in the first portion of the covering material aligns with an opaque section in the second portion of the covering material.

17. The method of claim 15, wherein when the covering material is in the privacy position, a transparent section in the first portion of the covering material aligns with an opaque section in the second portion of the covering material.

18. The method of claim 15, wherein moving the covering material to the view position comprises causing the motor to rotate the roller tube such that the bottom bar moves upward toward the roller tube until a transparent section in the first portion of the covering material aligns with a transparent section in the second portion of the covering material.

19. The method of claim 15, wherein when the covering material is in the view position, a transparent section in the first portion of the covering material aligns with a transparent section in the second portion of the covering material.

20. A motorized shade system comprising:

a housing;

a roller tube that is rotatably supported by the housing;

a covering material having a first end that is windingly attached to the roller tube and a second end that is attached to the housing; and a motor drive unit that includes a motor that is operatively coupled to the roller tube and a control system, wherein the control system is configured to cause the motor to rotate the roller tube to:

move the covering material between an open position and a closed position;

when movement of the covering material is halted with the covering material in an intermediate position that is between the open and closed positions, and based on an indication that visualization through the covering material is not desired, automatically move the covering material to a privacy position; and when movement of the covering material is halted with the covering material in an intermediate position that is between the open and closed positions, and based on an indication that visualization through the covering material is desired, automatically move the covering material to a view position.

21. The motorized shade system of claim 20, further comprising a bottom bar that is configured to be movably supported by the covering material, such that a first portion of the covering material extends from the roller tube to the bottom bar and a second portion of the covering material extends from the bottom bar to the second end.

22. The motorized shade system of claim 21, wherein the covering material defines respective pluralities of opaque and transparent sections that are arranged in an alternating pattern between the first and second ends.

23. The motorized shade system of claim 22, wherein when the covering material is in the privacy position, a transparent section in the first portion of the covering material aligns with an opaque section in the second portion of the covering material, such that visualization through the covering material is impeded.

24. The motorized shade system of claim 22, wherein the control system is further configured to move the covering material to the privacy position by causing the motor to rotate the roller tube such that the bottom bar moves downward away from the roller tube until a transparent section in the first portion of the covering material aligns with an opaque section in the second portion of the covering material, such that visualization through the covering material is impeded.

25. The motorized shade system of claim 22, wherein when the covering material is in the view position, a transparent section in the first portion of the covering material aligns with a transparent section in the second portion of the covering material, such that visualization through the covering material is permitted.

26. The motorized shade system of claim 22, wherein the control system is configured to move the covering material to the view position by causing the motor to rotate the roller tube such that the bottom bar moves upward toward the roller tube until a transparent section in the first portion of the covering material aligns with a transparent section in the second portion of the covering material, such that visualization through the covering material is permitted.

27. The motorized shade system of claim 21, wherein when the covering material is in the open position, the bottom bar is disposed near an upper end of an opening and a portion of the covering material is wound about the roller tube, and when the covering material is in the closed position, the bottom bar is disposed near a lower end of the opening, such that the covering material covers the opening, and wherein the control system is further configured to cause the motor to rotate the roller tube to:

upon receiving a first preset command, move the covering material to a preset privacy position in which the bottom bar is disposed near the lower end of the opening and visualization through the covering material is impeded; and upon receiving a second preset command, move the covering material to a preset view position in which the bottom bar is disposed near the lower end of the opening and visualization through the covering material is permitted.

28. The motorized shade system of claim 21, wherein the control system is further configured to track movement of the bottom bar relative to the roller tube.

29. The motorized shade system of claim 20, wherein the control system is further configured to determine that visualization through the covering material is not desired if the covering material is moving toward the closed position when movement of the covering material is halted.

30. The motorized shade system of claim 20, wherein the control system is further configured to determine that visualization through the covering material is desired if the covering material is moving toward the open position when movement of the covering material is halted.

* * * * *